United States Patent [19]

Gunn et al.

[11] Patent Number: 5,007,541

[45] Date of Patent: Apr. 16, 1991

[54] CARTON FOR GRANULAR MATERIALS

[75] Inventors: Charles L. Gunn, Lawrenceburg, Ind.; Harold Davis, Reading, Ohio; Milton D. Spahni, Jr., Harrison, Ohio; Ronald H. Wanless, Lebanon, Ohio

[73] Assignee: The Procter & Gamble Company, Cincinnati, Ohio

[21] Appl. No.: 495,258

[22] Filed: Mar. 16, 1990

[51] Int. Cl.[5] ..... B65D 5/54

[52] U.S. Cl. ..... 206/611; 206/608

[58] Field of Search ..... 206/611, 624, 629, 608

[56] References Cited

U.S. PATENT DOCUMENTS

| | | | |
|---|---|---|---|
| 1,793,025 | 2/1931 | Spitzenberger . | |
| 2,122,885 | 7/1938 | Lowey | 229/33 |
| 2,919,060 | 12/1959 | Daniels . | |
| 3,111,255 | 11/1963 | Skowronski | 206/611 |
| 3,131,851 | 5/1964 | Pace | 206/624 |
| 3,168,975 | 2/1965 | Buttery et al. | 206/611 |
| 3,197,115 | 7/1965 | Peter | 206/624 |
| 3,206,103 | 9/1965 | Bixler | 206/624 |
| 3,219,257 | 11/1965 | Anderson | 206/611 |
| 3,239,129 | 3/1966 | Schilling et al. | 229/51 |
| 3,252,651 | 5/1966 | Holmes | 206/624 |
| 3,283,991 | 11/1966 | Hughes | 229/51 |
| 3,338,505 | 8/1967 | Hughes | 229/51 |
| 3,409,205 | 11/1968 | Meyers | 206/624 |
| 3,434,849 | 3/1969 | Carbone | 206/611 |
| 3,441,193 | 4/1969 | Castle | 229/33 |
| 3,593,911 | 7/1971 | Pellaton | 229/45 |
| 4,289,239 | 9/1981 | Meyers | 206/625 |
| 4,679,694 | 7/1987 | Donohie et al. | 206/624 |

FOREIGN PATENT DOCUMENTS

| | | | |
|---|---|---|---|
| 814827 | 6/1969 | Canada | 206/611 |

*Primary Examiner*—Gary E. Elkins

*Attorney, Agent, or Firm*—R. C. Witte; J. V. Gorman; M. E. Hilton

[57] ABSTRACT

A container for housing granular materials and a blank for forming the container. The container is a six sided enclosure including a top wall, a back wall, a bottom wall, a front wall and two end walls. The front wall has an inner layer and an outer layer. The outer layer has a transverse tear strip therein and is attached to the inner layer below this tear strip. A glue flap is attached to the interior surface of the top wall and also attached to the top edge of the inner layer of the front wall along a perforated cut line. This configuration prevents the granular material from migrating between the layers of the front wall during shipping. Each end wall is comprised of several layers. Included are two main layers which together have a top edge. A tear strip panel extension is attached to the main layers below the tear strip. An ear is attached to the tear strip panel extension above the tear strip and also attached to the top wall. The ear holds the top wall against the top edge of the main layers to prevent the granular material from migrating between the tear strip panel extensions and the main panels during shipping.

20 Claims, 10 Drawing Sheets

CARTON FOR GRANULAR MATERIALS

BACKGROUND OF THE INVENTION

1. Field of the Invention

The present invention relates to cartonboard containers, and more particularly, to such containers which are suitable for housing granular materials.

2. Description of the Prior Art

Cartonboard containers have been available for many years. The ability to readily fill, open and dispense from these containers have long been important goals of those skilled in the art. One way to accomplish these goals is to use a side fill container which can be opened by the removal of a tear strip. These containers are commonly used for housing products such as ice cream. Examples of these containers are found in various United States Patents.

One patent of particular interest is U.S. Pat. No. 3,239,129 which issued to Schilling et al. on Mar. 8, 1966. This Patent discloses a side fill, tear strip opening container. The front wall of the container is made with an inner and an outer layer; the tear strip is in the outer layer. The end walls of the container include five total layers; only one of which has the same overall dimensions as the end wall.

Existing containers of this type, however, suffer from at least one major drawback when used with granular materials. They are generally not sift proof and spillage, therefore, often accompanies transporting and opening of the container. During transit the granules migrate into the spaces between layers and through any cracks and crevices. For example, the granules have a way of working themselves between the inner layer which remains stationary and the outer layer which is moved during opening. Thus, when the outer layer is moved as the carton is opened these granules are left unsupported and fall. The resulting mess that is created is unsatisfactory to consumers.

Accordingly, it is an object of the present invention to provide a container for housing granular materials which is easy to fill, open and dispense therefrom;

It is also an object of the present invention to provide such a container which substantially eliminates the problem of granular contents spilling upon opening;

It is additionally an object of the present invention to provide such a container which is filled from the side;

It is further an object of the present invention to provide such a container which is opened by the removal of a tear strip, forming a reclosing lid;

It is lastly an object of the present invention to provide a container which accomplishes the aforementioned objectives at minimal costs.

SUMMARY OF THE INVENTION

In accordance with one aspect of the present invention a side fill container is provided for housing granular material. The container is a six sided enclosure including a top wall and a bottom wall opposing each other, a front wall and a back wall opposing each other and two side walls opposing each other. Each of the end walls has two main layers attached to each other in face to face relation. The main layers have a top edge. A third layer is attached to the main layers. A fourth layer which has a horizontal tear strip therein is attached to the outside of the main layers below the tear strip. The front wall has an inner layer with a top edge and an outer layer. The outer layer has a horizontal tear strip therein which connects with the tear strips of the end walls to form one continuous tear strip. The inner and outer layers are attached to each other below the tear strip. An ear is attached to each end wall above the tear strip and is also attached to the top wall. The ear holds the top wall against the top edge of the main layers. A glue flap is attached to the top edge of the inner layer of the front wall via a perforated score line. The glue flap is also attached to the top wall.

In accordance with another aspect of the present invention a blank is provided for forming the above-described container. The blank includes a tear strip panel which has an extension panel attached along axial score lines to each axial edge of the tear strip panel. The tear strip panel and extension panels have a transverse tear strip therein. A top panel is attached along its upper transverse edge to the lower transverse edge of the tear strip panel. A back panel is attached along its upper transverse edge to the lower transverse edge of the top panel. The back panel has a major flap with a transverse dimension substantially equivalent to the axial dimension of the top panel attached along axial score lines to each axial edge of the back panel. A bottom panel is attached along its upper transverse edge to the lower transverse edge of the back panel. The bottom panel has a minor flap attached along axial score lines to each axial edge of the bottom panel. A front panel is attached along its upper transverse edge lo the lower transverse edge of the bottom panel. The front panel has a major flap with a transverse dimension substantially equivalent to the axial dimension of the top panel attached along axial score lines to each axial edge of the front panel. An ear is attached along a score line to one of each axial edge of the top panel or each lower transverse edge of the tear strip extension panels. A glue flap is attached along its upper transverse edge to the lower transverse edge of the front panel via a transverse perforated cut line.

BRIEF DESCRIPTION OF THE DRAWINGS

While the specification concludes with claims which particularly point out and distinctly claim the invention, it is believed the present invention will be better understood from the following description of preferred embodiments taken in conjunction with the accompanying drawings, in which like reference numerals identify identical elements and wherein;

DESCRIPTION OF THE PREFERRED EMBODIMENT

Figure 1:
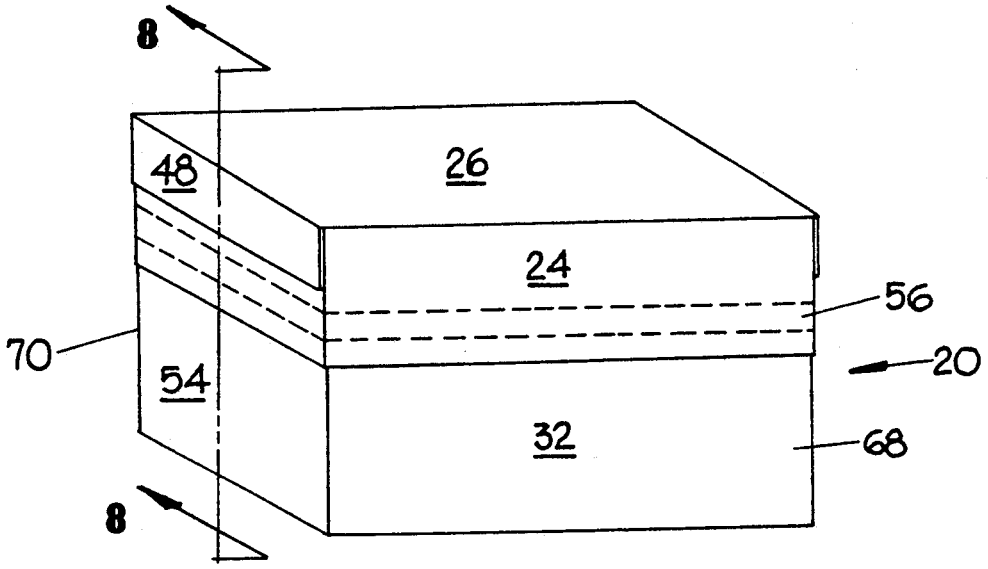
FIG. 1 is a perspective view of a preferred embodiment of the present invention, seen in the closed orientation.
Figure 2:
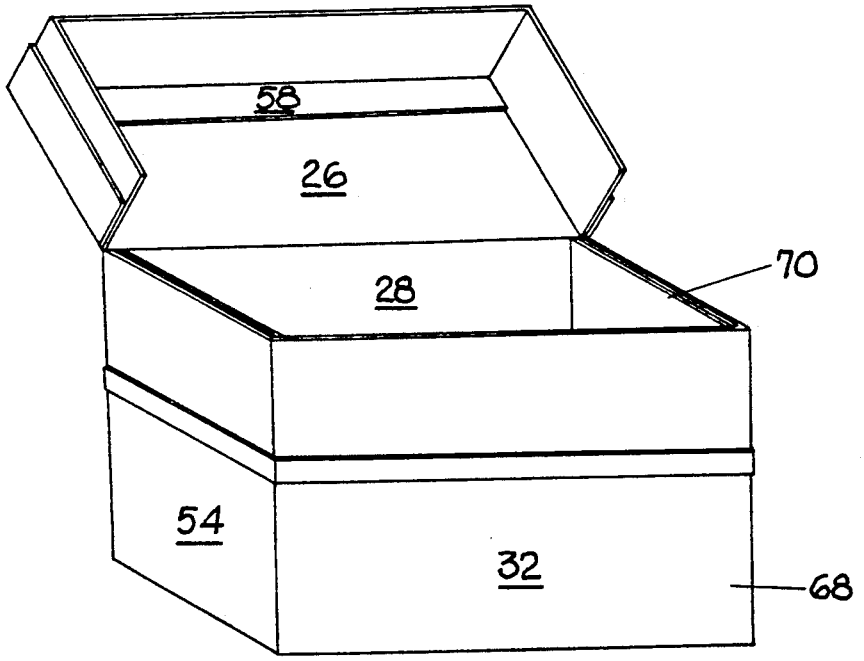
FIG. 2 is a perspective view of the container of FIG. 1, seen in an open orientation.

In a particularly preferred embodiment seen in FIG. 1, the present invention provides a side fill carton for housing granular materials, indicated generally as 20. The embodiment of FIG. 1 is made from the blank illustrated in FIG. 3.

Figure 3:
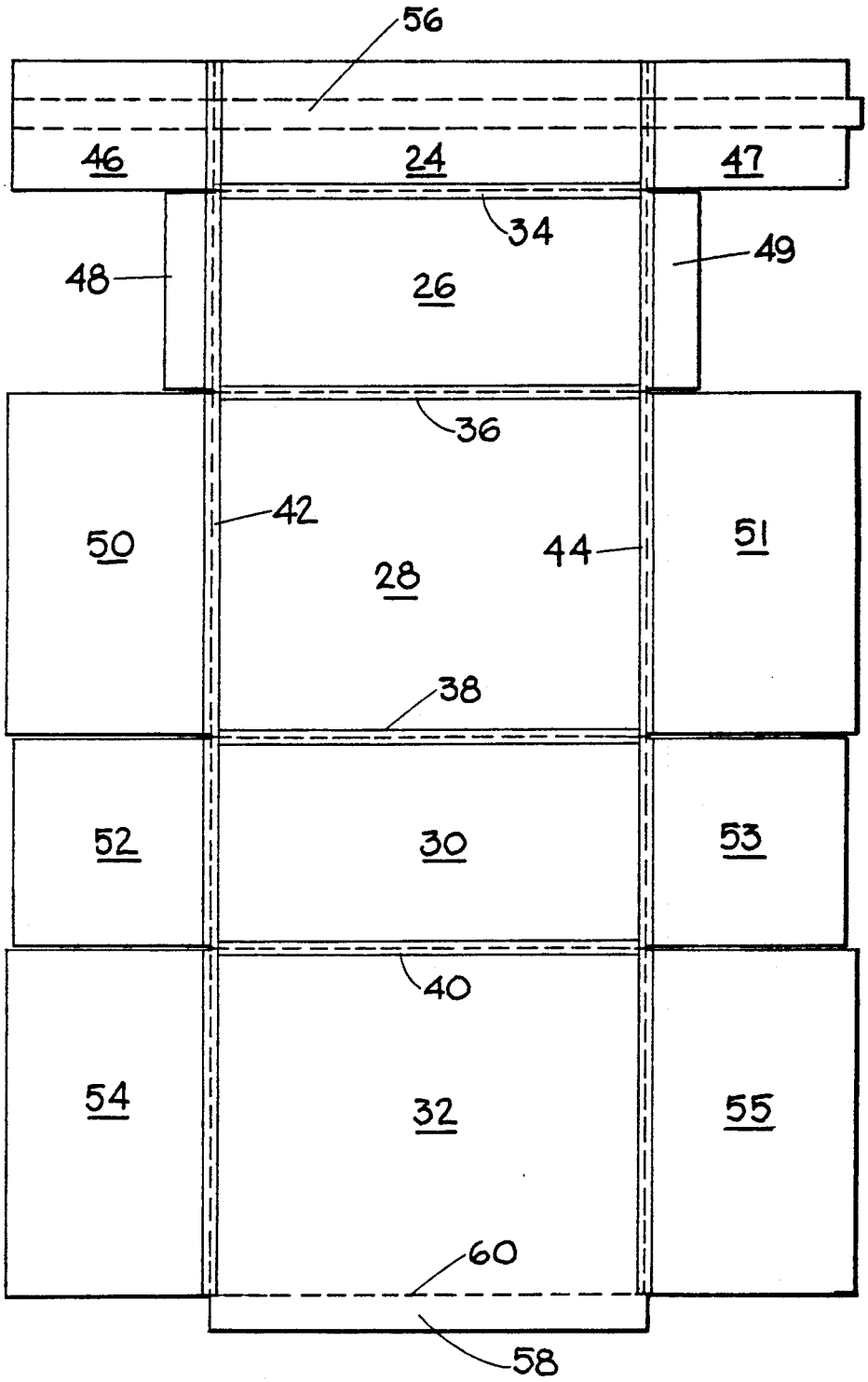
FIG. 3 is a top plan view of the blank used to make the container of FIG. 1.

Referring to FIG. 3, the blank incorporates five main panels 24, 26, 28, 30 and 32 which are successively connected to each other along transverse score lines 34, 36, 38, and 40. The five main panels, from top to bottom, include a tear strip panel 24, a top panel 26, a back panel 28, a bottom panel 30 and a front panel 32. The transverse score lines 34, 36, 38 and 40 define the boundaries of each of these panels 24, 26, 28, 30, and 32 and also serve to connect each panel with the adjacent panels. The boundaries of each of these panels 24, 26, 28, 30 and 32 are further defined by axial score lines 42 and 44. The axial score lines 42 and 44 also serve to connect each panel 24, 26, 28, 30 and 32 to an end flap 46 through 55 at each transverse edge.

The end flaps associated with the front panel 32 and the back panel 28 are the major flaps 50, 51, 54 and 55. The major flaps 50, 51, 54 and 55 preferably have substantially the same transverse dimension as the axial dimension of the top panel 26; and even more preferably, have substantially the same overall dimensions as the resulting end wall of the container 20. The end flaps associated with the bottom panel 30 are the minor flaps 52 and 53. The minor flaps 52 and 53 are somewhat smaller in transverse dimension than the major flaps 50, 51, 54 and 55. The end flaps associated with the top panel 26 will hereinafter be referred to as ears 48 and 49. The transverse dimension of the ears 48 and 49 is substantially smaller than the transverse dimension of the major flaps 50, 51, 54 and 55.

The end flaps associated with the tear strip panel 24 will hereinafter be referred to as extension panels 46 and 47. In this embodiment these extension panels 46 and 47 have substantially the same transverse dimension as the major flaps 50, 51, 54 and 55. The tear strip panel 24 and its associated extension panels 46 and 47 have a transverse tear strip 56 located therein. This tear strip 56 is preferably two transverse parallel lines 50% cut into the outer side of the tear strip panel 24 and extension panels 46 and 47. A 50% cut is a continuous cut which extends from the surface of the material down to a depth which is half of the thickness of the material. The 50% cut assures a clean tear at the surface which leaves a relatively pleasing appearance; particularly when the container 20 is printed. Attached to the inner side of this tear strip 56 is a polypropylene reinforcing tape. This tape helps prevent the tear strip 56 from breaking into two pieces as it is being removed from the container 20. One end of the tear strip 56 extends beyond the axial edge of the extension panel 47. This extension provides a tab which facilitates grasping of the tear strip 56.

A glue flap 58 is attached to one transverse edge of the front panel 32 via a perforated cut line 60. The perforated cut line 60 preferably has cuts which are small enough to prevent substantially all of the granular material from flowing therethrough during shipment as will be discussed hereinafter.

Figure 4:
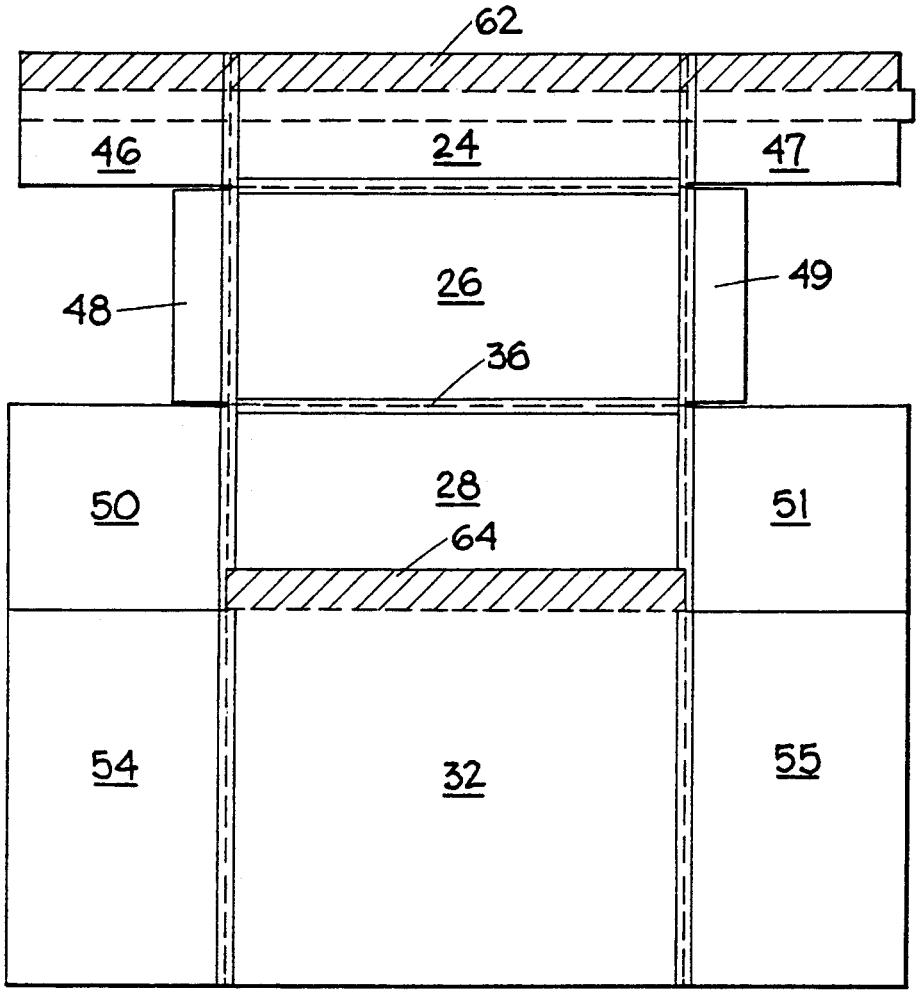
FIG. 4 is a top plan view of the blank of FIG. 3 after initial folding, showing the glue areas.
Figure 5:
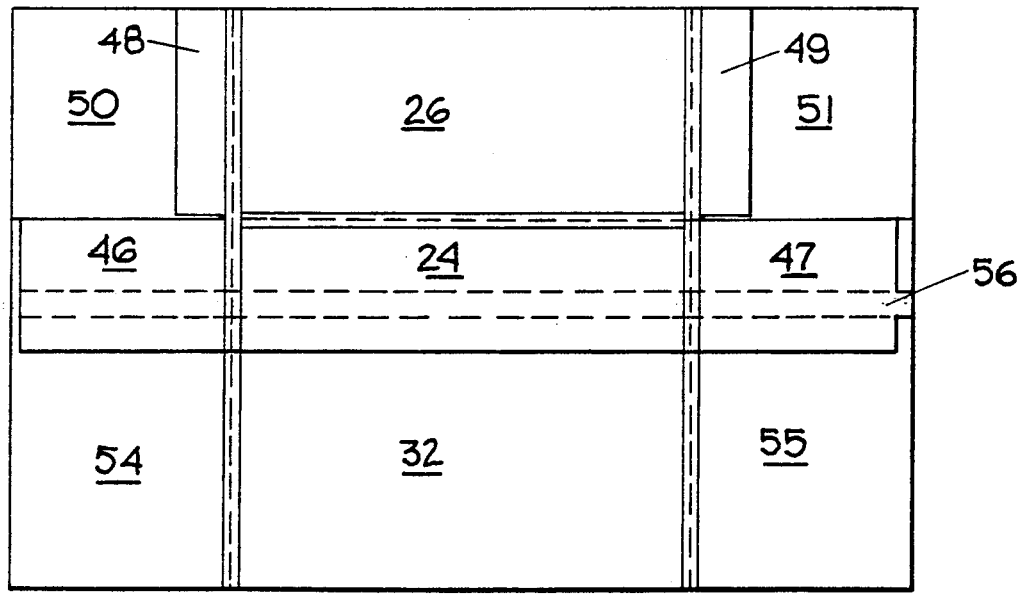
FIG. 5 is a top plan view of the sleeve made from the blank of FIG. 3.

To assemble the container 20 the blank of FIG. 3 is first folded and glued to form the sleeve shown in FIG. 5. Initially glue is placed in the glue areas 62 and 64 indicated in FIG. 4 and the blank is folded 180° about the transverse score line 36 which separates the top panel 26 from the back panel 28. The blank is then folded 180° about the transverse score line 40 which separates the front panel 32 from the bottom panel 30. Thus, the glue flap 58 is adhered to the inner side of the top panel 26 and the tear strip panel 24 and extension panels 46 and 47 are adhered below the tear strip 56 to the front panel 32 and the major flaps 54 and 55 associated therewith. This configuration, seen in FIG. 5, is referred to as a sleeve. The sleeve is an economical and efficient form commonly used to ship in containers to the product packager.

Figure 6:
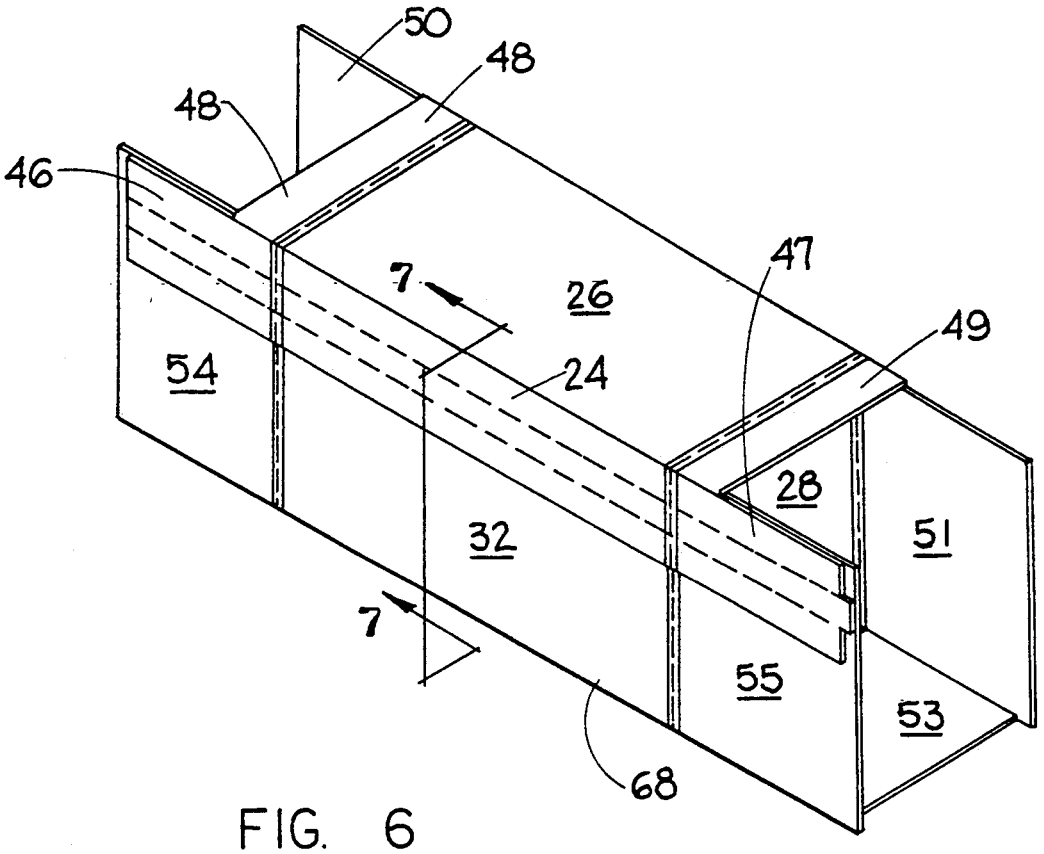
FIG. 6 is a perspective view of the blank of FIG. 3 after being squared for transformation into the container of FIG. 1.
Figure 8:
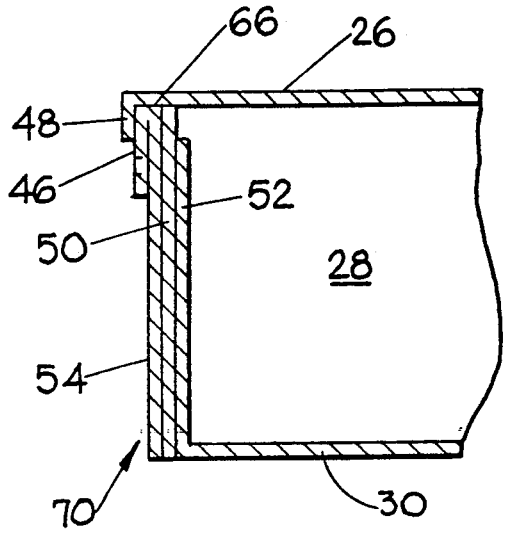
FIG. 8 is a fragmentary cross-sectional view taken along line 8—8 of FIG. 1 showing the wall construction of the container of FIG. 1.

Once received by the product packager the sleeve is set up, one end is folded and sealed, the container 20 is filled, and then the other end is folded and sealed. As seen in FIG. 6, to set up the container 20 the sleeve is squared so that each of the five main panels 24, 26, 28, 30 and 32 are at substantially right angles to their adjacent panels. To fold and seal one end the minor flap 52 associated with the bottom panel 30 is first folded 90° about the axial score line 44 to a position perpendicular to the bottom panel 30. The major flap 50 associated with the back panel 28 is folded 90° about the axial score line 42 and preferably adhered to the bottom panel 30 end flap 52. The major flap 54 associated with the front panel 32 and the tear strip 46 extension panel adhered thereto are then folded 90° about the axial score line 42 and adhered to the exterior side of the major flap 50 of the back panel 28. Lastly, the ear 48 associated with the top wall 26 is folded 90° and adhered to the exterior of the tear strip 24 extension panel 46. As seen in FIG. 8, the top wall 26 ear 48 is folded over and attached such that the top wall 26 is pulled down against the top edge 66 of the major flaps 50 and 54 creating a barrier to granular movement.

The container 20 is oriented on its side and filled through the remaining open end with a granular material and the other end is folded and sealed. The folding and sealing operation of this end is identical to the folding and sealing operation described above. At this point the container 20 is filled, sealed and ready for shipment.

Referring to FIG. 1, the container 20 is an enclosure formed by the various panels and flaps. These panels and flaps are the corresponding walls of the container 20. The top 26, bottom 30, and back 28 panels are the top 26, bottom 30, and back 28 walls, respectively. The front wall 68 is made up of the front panel 32 and the tear strip panel 24. The end walls 70 are made from the remaining flaps, panels and ears. The top wall 26 opposes the bottom wall 30, the front wall 32 opposes the back wall 28 and the end walls 70 oppose each other.

Figure 7:
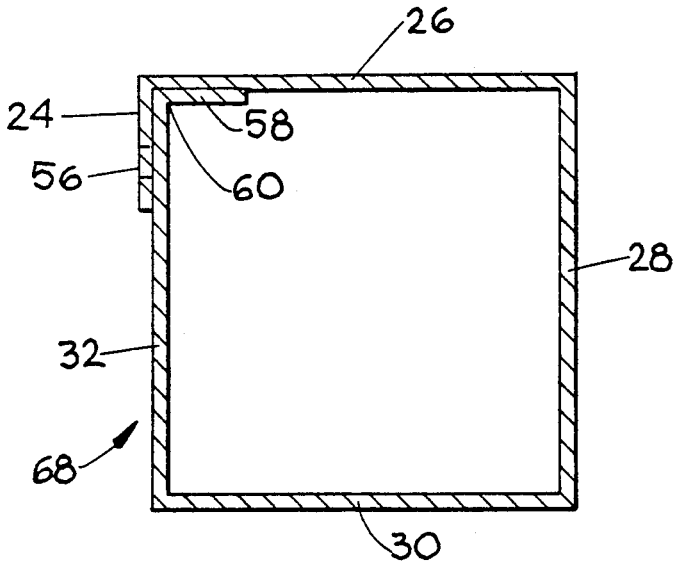
FIG. 7 is a cross-sectional view taken along line 7—7 of FIG. 6 showing the wall construction of the container of FIG. 1.

The walls of the container 20 as assembled are seen in FIGS. 7 and 8. Referring to FIG. 8, each end wall 70 includes a total of five layers. The innermost layer is the minor flap 52 associated with the bottom wall 30. The second layer is the major flap 50 associated with the back wall 28. The middle and fourth layers are the major flap 54 associated with the front wall 32 and the extension panel 46 of the tear strip panel 24, respectively. The outermost layer is the ear 48 associated with the top wall 26. As seen in the drawing, the top wall 26 is pulled tightly against the top edge 66 of the major flaps 50 and 54. This provides a sift proof barrier which prevents granules from migrating during shipment to the space between the major flap 54 associated with the front wall 32 and the tear strip panel 24 extension panel 46. If granules migrate to this area spillage will result upon opening of the container 20. In addition to providing a sift proof barrier, the major end flaps 50 and 54, being coextensive, i.e., having substantially the same dimensions as the end wall 70, provide added strength to the container 20.

Referring to FIG. 7, the front wall 68 is formed of two layers. The layers of the front wall 68 are formed from the front panel 32 and the tear strip panel 24. These layers are attached to each other below the tear strip 56. The top wall 26 has the glue flap 58 attached thereto. The glue flap 58 is also attached to the front panel 32 via the perforated cut line 60. The perforated cut line 60 substantially prevents the migration of granules in the area between the front panel 32 and the tear strip panel 24. It has been found that virtually any perforation will accomplish this task. Therefore, it is preferred that the perforated cut line 60 barely hold the glue flap 58 to the front panel 32 which makes opening the container 20 easier. The perforated cut line 60 of this embodiment is a repeating pattern of a 3/8" cut followed by a ⅜' land.

To open the container 20 the user grasps the tab of the tear strip 56 and pulls the tear strip 56 away from the container 20. This separates the top, which includes the tear strip panel 24 and associated panel extensions 46 and 47 above the tear strip 56, the top wall 68 and the ears 48 and 49, from the remainder of the container 20. The top is a three sided lid which is now free to rotate. As the top lid is rotated about the transverse score line 36 which joins the top wall 26 to the back wall 28. The glue flap 58 is separated from the front panel 32. Rotating the top lid along this score line 36 to an open position allows access the contents of the container 20. After dispensing the desired amount of granular products, the container 20 may be closed by rotating the top back to the closed position.

Figure 9:
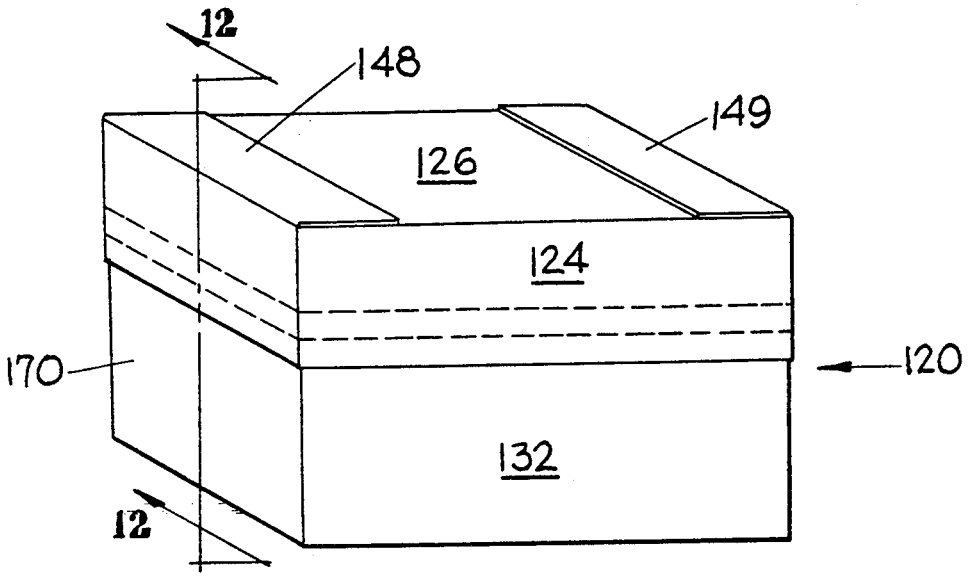
FIG. 9 is a perspective view of a second preferred embodiment of the present invention, seen in the closed orientation.
Figure 10:
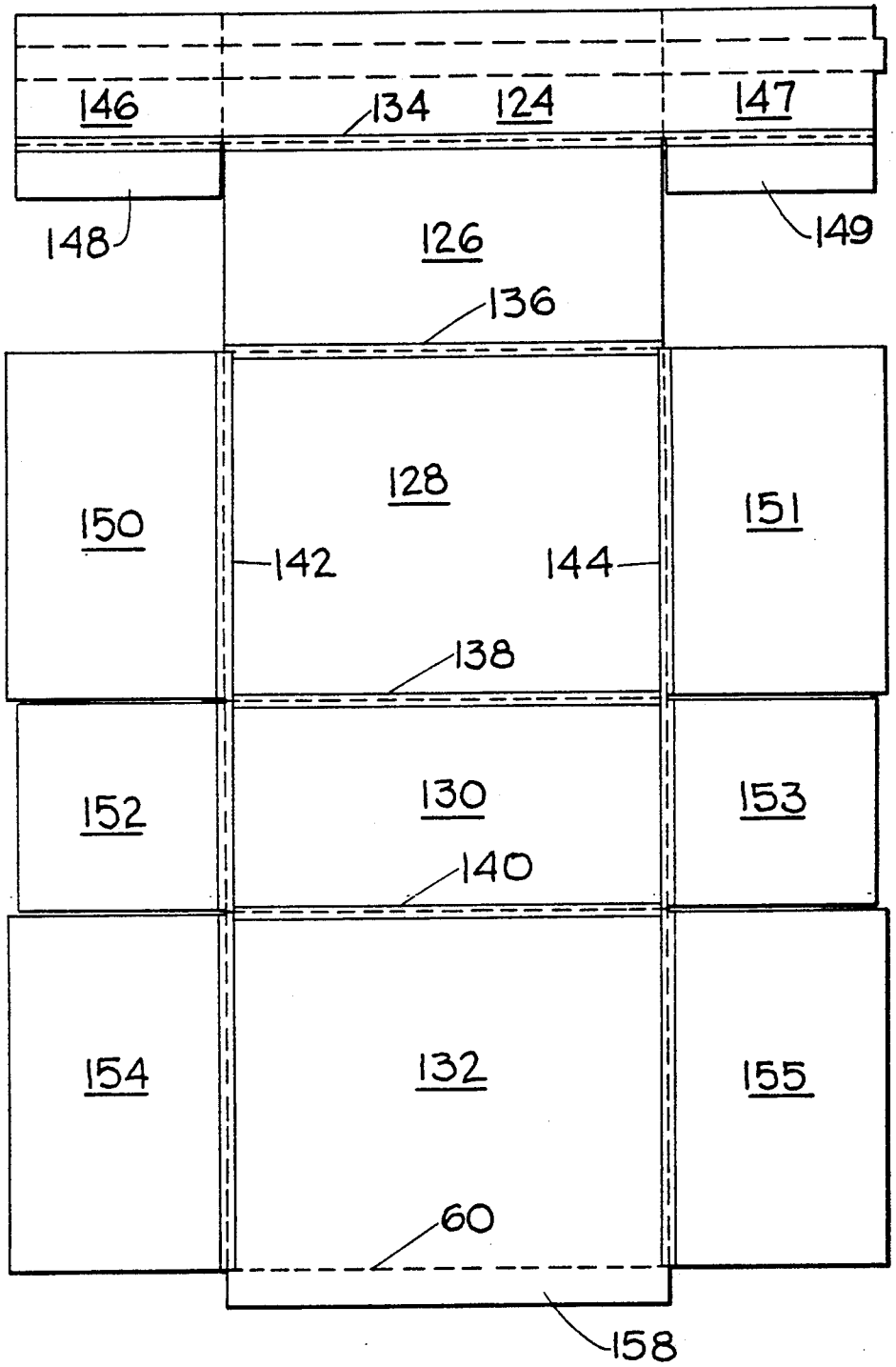
FIG. 10 is a top plan view of the blank used to make the container of FIG. 9.

A second preferred embodiment can be seen in FIG. 9. This second embodiment is made from the blank of FIG. 10. The blank of FIG. 10 is virtually identical to the blank of FIG. 3. The only difference is that the ears 148 and 149 extend from the tear strip panel 124 extension panels 146 and 147 along transverse score line 134 rather than from the top panel 126. The top panel 126 has no end flaps attached to its axial edges. As seen in FIG. 9, this blank results in a container 120 having the ears 148 and 149 attached to the top wall 126.

Figure 11:
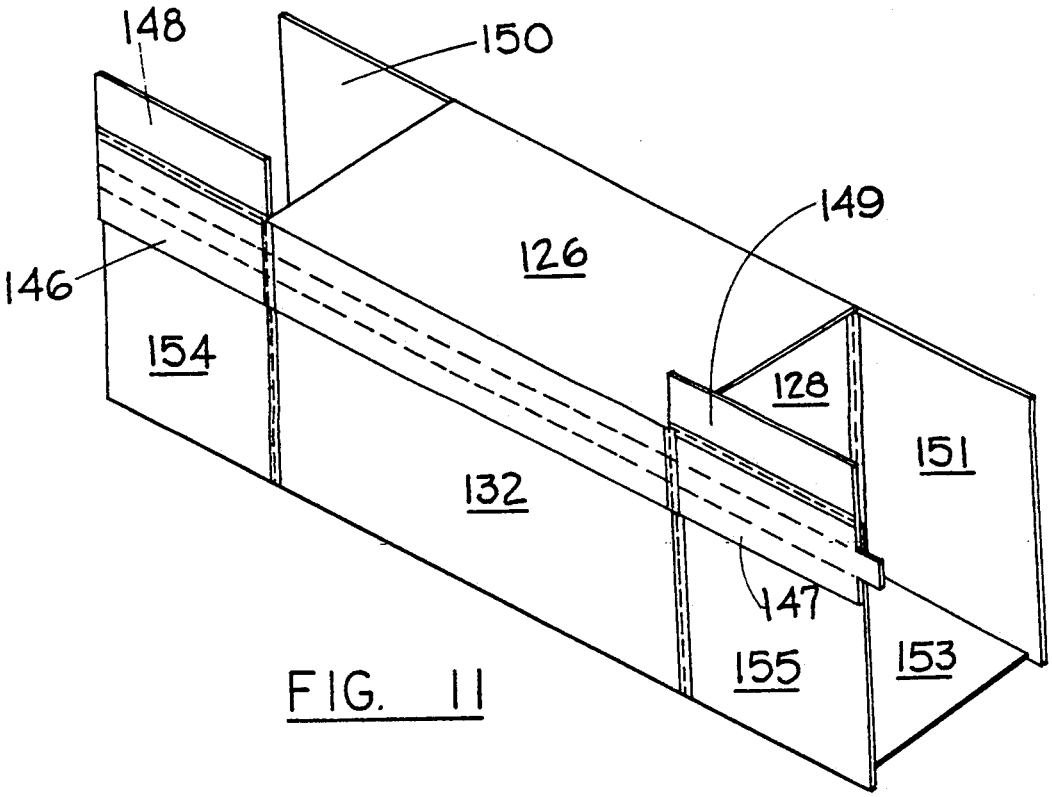
FIG. 11 is a perspective View of the blank of FIG. 10 after being squared for transformation into the container of FIG. 9.

This blank is folded and glued into the sleeve configuration for shipment to the product packager as with the previous embodiment. Upon receipt by the packager the container 120 is squared as seen in FIG. 11. Folding and sealing the ends requires a slightly different operation, however, than the previous embodiment. As described before the bottom panel 130 minor flap 152, the back panel 128 major flap 150, and then the front panel 132 major flap 154 and the tear strip panel 124 extension panel 146 are sequentially folded 90° and glued to the adjacent flaps. Then the ear 148 which is connected to the tear strip panel 124 extension panel 146, is folded about the score line 134 and glued to the top wall 126. This last step is done such that the top panel 126 is pressed tightly against the top edge 166 of the major flaps 150 and 154 creating a sift proof barrier. The same operation is followed to seal the other end of the container 120.

Figure 12:
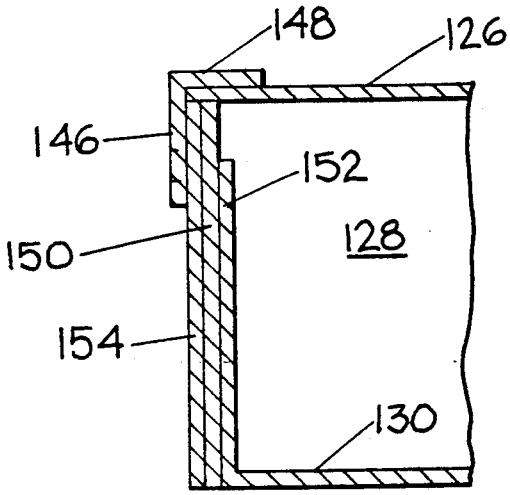
FIG. 12 is a fragmentary cross-sectional view taken along line 12—12 of FIG. 9 showing the wall construction of the preferred embodiment.

Referring to FIG. 12, the container 120 of FIG. 9 is shown in cross section. Each end wall consists of four layers. The innermost layer is the bottom panel 130 minor flap 152. The next layers are the back wall 128 major flap 150 followed by the front wall 132 major flap 154. The outer most layer is the tear strip 124 extension panel 146. The top wall 26 has the ear 148 attached thereto. The ear 148 is connected along the score line 134 to the tear strip extension panel 146.

Figure 13:
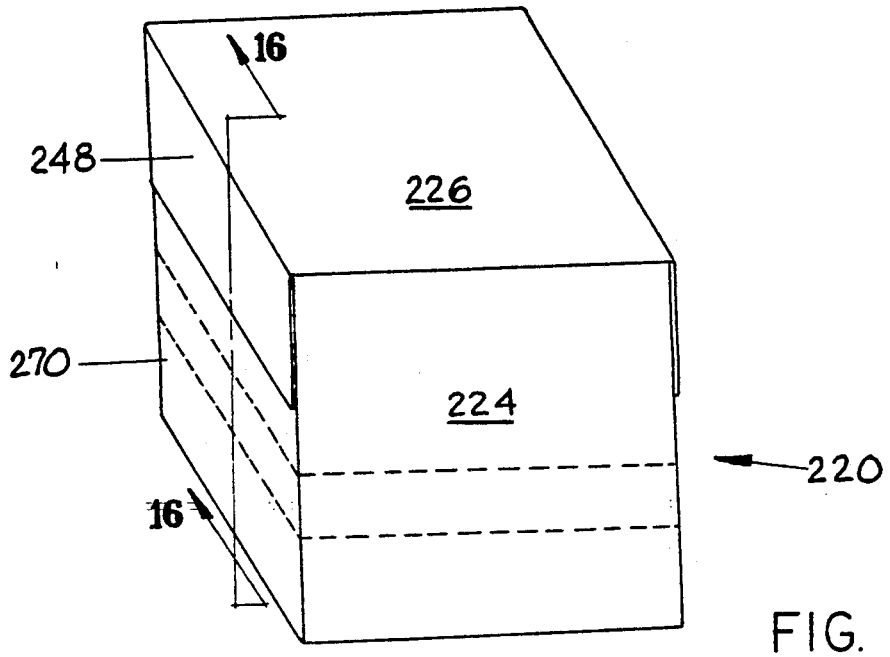
FIG. 13 is a perspective view of a third preferred embodiment of the present invention, seen in the closed orientation.
Figure 14:
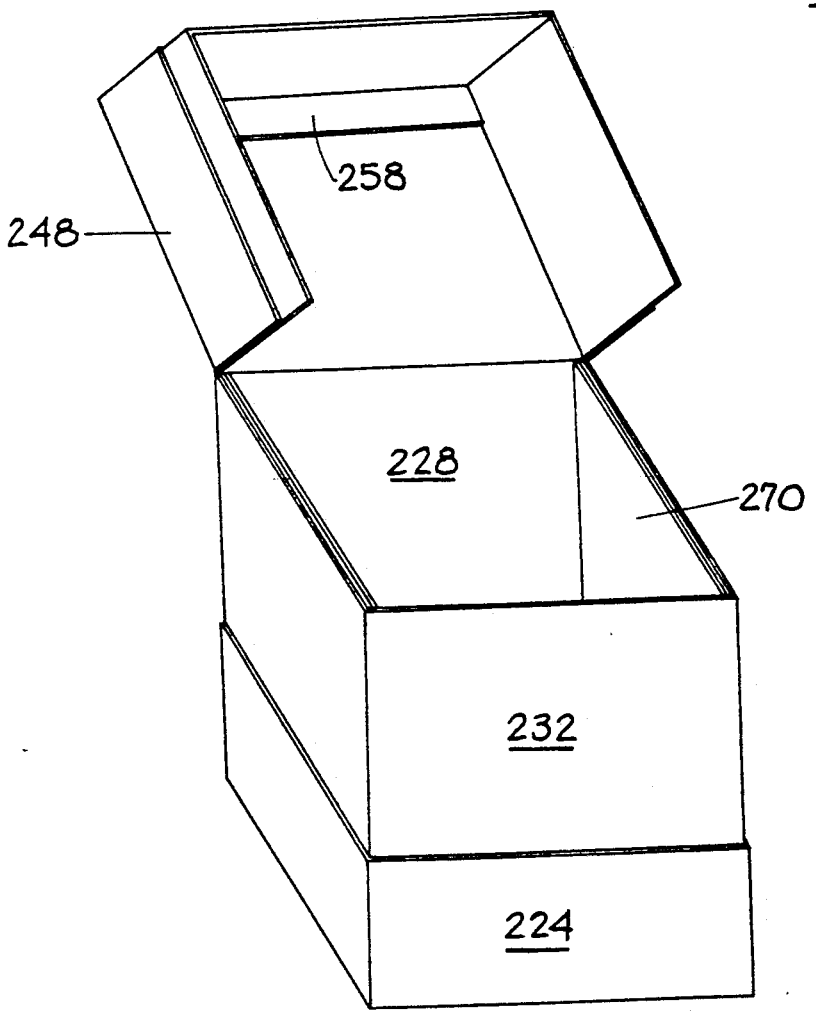
FIG. 14 is a perspective view of the container of FIG. 13, seen in the open orientation.
Figure 15:
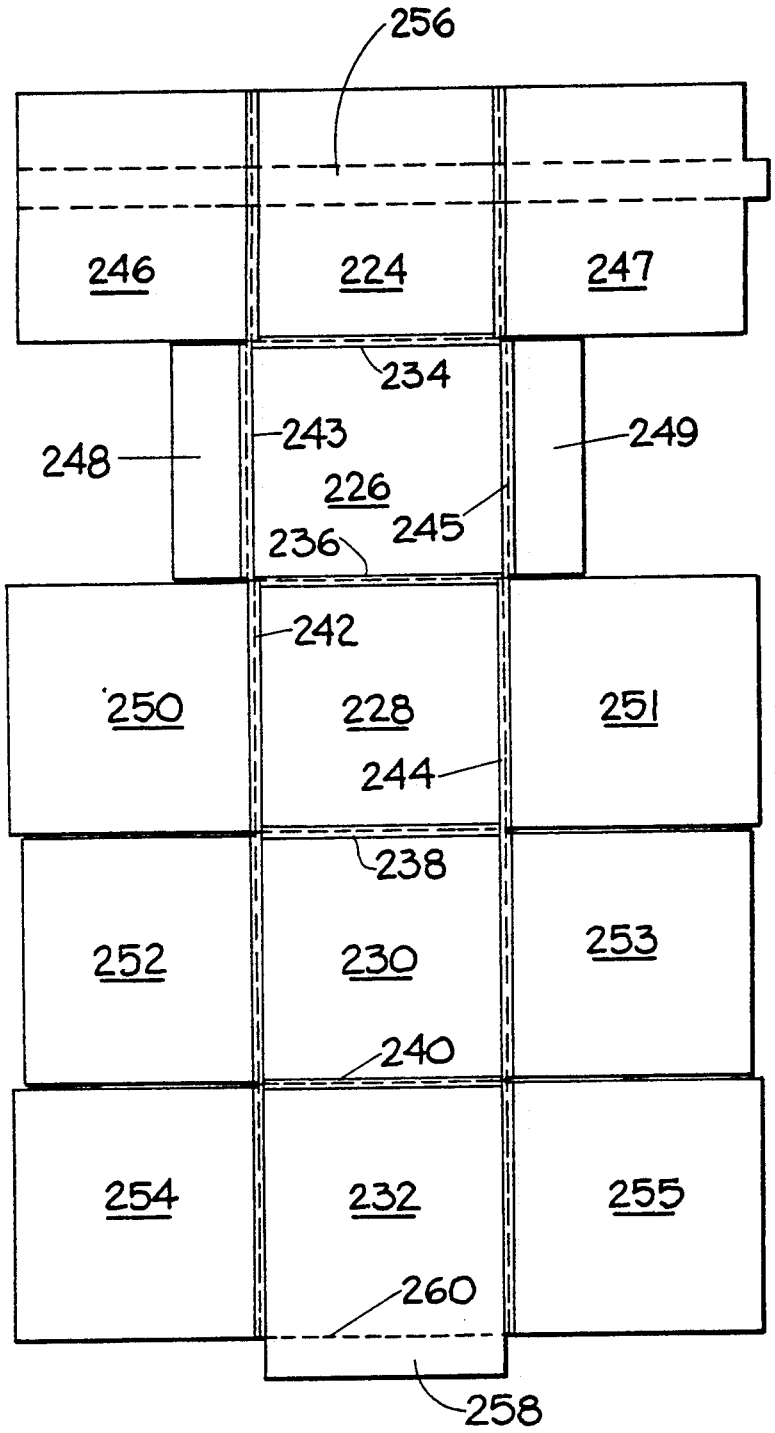
FIG. 15 is a top plan view of the blank used to make the preferred embodiment of FIG. 13.

A third preferred embodiment of the container 220, seen in FIGS. 13 and 14, is made from the blank of FIG. 15. This embodiment has a generally cube shape. The modifications of this embodiment could, however, be incorporated into the embodiments of FIGS. 1 and 9. One main difference between the blank of FIG. 15 and the blank of FIG. 3 is the size of the tear strip panel 224 and the extension panels 246 and 247 associated therewith. The tear strip panel 24 of FIG. 3 has an axial dimension which is substantially less than the axial dimension of the front panel 32. The tear strip panel 224 of FIG. 15, however, has an axial dimension substantially equivalent to the axial dimension of the front panel 232. Additionally, the tear strip panel 224 extension panels 246 and 247 are substantially identical in overall dimension to the major flaps 250, 251, 254 and 255.

Another main difference between the blanks of FIGS. 3 and 15 is that the minor flaps 252 and 253 associated with the bottom wall 230 are substantially equivalent in axial dimension and only slightly shorter in transverse dimension than the major flaps 250, 251, 254 and 255. Another difference between the two blanks is the axial score lines 243 and 245 separating the ears 248 and 249 from the top wall 226 are slightly further apart than the axial score lines 242 and 244 separating the remaining panels from their associated end flaps/extension panels. One other difference is the dimension of the perforated cut line 260. The perforated cut line 260 of this embodiment is a repeating pattern of a 3/16" cut followed by a 1/32" land.

The blank is folded and glued like the other embodiments into the sleeve configuration. The sleeve is squared and folded and sealed using the identical procedure discussed with reference to the embodiment of FIG. 1. In this embodiment, each layer of the front wall 268 is coextensive.

Figure 16:
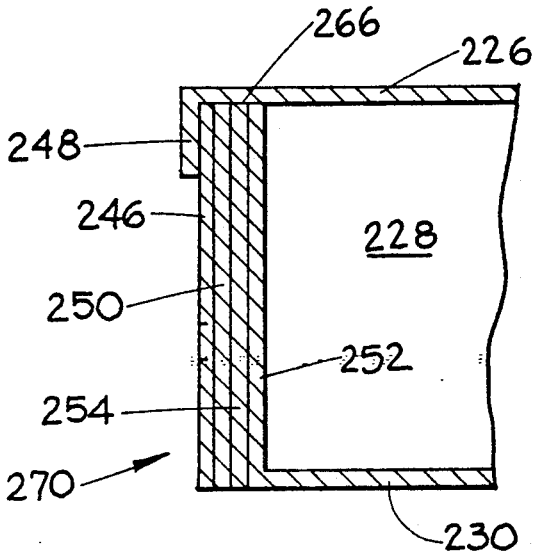
FIG. 16 is a fragmentary cross-sectional view taken along line 16—16 of FIG. 13 showing the wall construction of that container.

The embodiment of FIG. 13 is seen in cross section in FIG. 16. Referring to FIG. 16, the end wall 270 includes 5 layers. These are the same five layers as with the embodiment of FIG. 1. The only difference being that the tear strip panel 224 extension panels 246 and 247 are full sized, i.e., they have substantially the same overall dimensions as the end wall 270.

Although particular embodiments of the present invention have been shown and described, modification may be made to the package without departing from the teachings of the present invention. Accordingly, the present invention comprises all embodiments within the scope of the appended claims.

What we claim is:

1. A side fill container for housing granular materials comprising:

(a) an enclosure including a top wall and a bottom wall opposing each other, a front wall and a back wall opposing each other, and two end walls opposing each other, wherein:

(b) each of the end walls further comprises two main layers attached to each other in face to face relation and having a top edge, a third layer attached in face to face relation to the main layers, and a fourth layer having a horizontal tear strip therein, the fourth layer being attached to the main layers below the tear strip;

(c) the front wall further comprises an inner layer having a top edge and an outer layer, the outer layer having a horizontal tear strip therein which connects with the tear strips of the end walls forming one continuous tear strip, the inner and outer layers being attached to each other below the tear strip;

(d) an ear being attached to each of the end walls above the tear strip and further being attached to the top wall, the ear holding the top wall against the top edge of the main layers; and (e) a glue flap being attached to the top edge of the inner layer of the front wall via a perforated score line, the glue flap also being attached to the top wall.

2. A side fill container according to claim 1 wherein the main layers are coextensive with each other.

3. A side fill container according to claim 1, wherein each ear is attached to the top wall along a score line.

4. A side fill container according to claim 2 wherein the main layers are coextensive with each other.

5. A side fill container according to claim 1 wherein each ear is attached to a layer of the end wall along a score line.

6. A side fill container according to claim 2 wherein each ear is attached to a layer of the end wall along a score line.

7. A side fill container according to claim 1 wherein the tear strip panel is coextensive with the front panel.

8. A side fill container according to claim 2 wherein the tear strip panel is coextensive with the front panel.

9. A side fill container according to claim 3 wherein the tear strip panel is coextensive with the front panel.

10. A side fill container according to claim 2 wherein the two main layers are the main flaps extending from the front and back walls respectively and attached thereto along score lines.

11. A side fill container according to claim 3 wherein the two main layers are the main flaps extending from the front and back walls respectively and attached thereto along score lines.

12. A side fill container according to claim 5 wherein the two main layers are the main flaps extending from the front and back walls respectively and attached thereto along score lines.

13. A side fill container according to claim 10 wherein the third layer is the minor flap extending from the bottom panel and attached thereto along a score line.

14. A side fill container according to claim 11 wherein the third layer is the minor flap extending from the bottom panel and attached thereto along a score line.

15. A side fill container according to claim 13 wherein the fourth layer is the extension panel of the tear strip panel.

16. A side fill container according to claim 14 wherein the fourth layer is the extension panel of the tear strip panel.

17. A blank for forming a side fill container according to claim 1 comprising:

(a) a tear strip panel having an extension panel being attached along axial score lines to each axial edge of the tear strip panel, the tear strip panel and extension panels having a transverse tear strip therein;

(b) a top panel being attached along its upper transverse edge to the lower transverse edge of the tear strip panel;

(c) a back panel being attached along its upper transverse edge to the lower transverse edge of the top panel, the back panel having a major flap having a transverse dimension substantially equivalent to the axial dimension of the top panel attached along axial score lines to the each axial edge of the back panel;

(d) a bottom panel being attached along its upper transverse edge to the lower transverse edge of the back panel, the bottom panel having a minor flap attached along axial score lines to each axial edge of the bottom panel;

(e) a front panel being attached along its upper transverse edge to the lower transverse edge of the bottom panel, the front panel having a major flap having a transverse dimension substantially equivalent to the axial dimension of the top panel attached along axial score lines to each axial edge of the front panel;

(f) an ear being attached along a score line to one of each axial edge of the top panel or each lower transverse edge of the tear strip extension panels; and (g) a glue flap being attached along its upper transverse edge to the lower transverse edge of the front panel via a transverse perforated cut line.

18. A blank according to claim 17 wherein the major and minor flaps have substantially the same transverse dimensions.

19. A blank according to claim 17 wherein the top panel and the tear strip panel have substantially the same overall dimensions.

20. A blank according to claim 17 wherein the top panel has a transverse dimension slightly greater than the front panel.

* * * * *

UNITED STATES PATENT AND TRADEMARK OFFICE

CERTIFICATE OF CORRECTION

PATENT NO. : 5,007,541

DATED : April 16, 1991

INVENTOR(S) : C. L. Gunn, H. Davis, M. D. Spahni, Jr., R. H. Wanless

It is certified that error appears in the above-identified patent and that said Letters Patent is hereby corrected as shown below:

Column 2, line 28, "lo" should read -- to -- .

Column 3, line 6, "View" should read -- view -- .

Column 5, line 41, "3/8'" should read -- 1/16" -- .

Signed and Sealed this

Ninth Day of March, 1993

*Attest:*

STEPHEN G. KUNIN

*Attesting Officer*

*Acting Commissioner of Patents and Trademarks*